US006773024B2

(12) United States Patent
Walkhoff

(10) Patent No.: US 6,773,024 B2
(45) Date of Patent: Aug. 10, 2004

(54) DEVICE FOR LINKING A SPORTS EQUIPMENT WITH A SHOE

(75) Inventor: Klaus Walkhoff, Kreuzlingen (CH)

(73) Assignees: Sports Goods AG, Obfelden (CH); Renato P. Ruede, Obfelden (CH)

( * ) Notice: Subject to any disclaimer, the term of this patent is extended or adjusted under 35 U.S.C. 154(b) by 0 days.

(21) Appl. No.: 09/979,040

(22) PCT Filed: Mar. 16, 2001

(86) PCT No.: PCT/CH01/00167

§ 371 (c)(1),
(2), (4) Date: Mar. 18, 2002

(87) PCT Pub. No.: WO01/68198

PCT Pub. Date: Sep. 20, 2001

(65) Prior Publication Data

US 2003/0047911 A1 Mar. 13, 2003

(30) Foreign Application Priority Data

Mar. 16, 2000 (CH) ..... 505/2000

(51) Int. Cl.[7] ..... A63C 9/08
(52) U.S. Cl. ..... 280/613; 280/618; 280/634
(58) Field of Search ..... 280/613, 611, 280/617, 618, 623, 634, 605, 607, 626, 633, 625

(56) References Cited

U.S. PATENT DOCUMENTS 3,727,932 A * 4/1973 Druss et al. ..... 280/613
3,838,866 A * 10/1974 D'Alessio et al. ..... 280/618
3,918,732 A * 11/1975 Wulf ..... 280/618
3,925,911 A * 12/1975 Erlebach ..... 36/117.4
4,154,458 A * 5/1979 Wehrli ..... 280/605
4,196,920 A * 4/1980 Salomon ..... 280/613
4,278,269 A * 7/1981 Beyl ..... 36/117.3
4,286,397 A * 9/1981 Booty ..... 36/132
4,386,788 A * 6/1983 Krob ..... 280/605
4,880,251 A * 11/1989 Wulf et al. ..... 280/613
4,923,207 A * 5/1990 Pozzobon ..... 280/613
5,551,721 A * 9/1996 Renaud-Goud et al. ..... 280/605
5,947,508 A * 9/1999 Graf et al. ..... 280/616

FOREIGN PATENT DOCUMENTS

DE 27 39 208 3/1978
EP 0 031 570 A1 12/1980

* cited by examiner

*Primary Examiner*—Brian L. Johnson
*Assistant Examiner*—Brian L Swenson
(74) *Attorney, Agent, or Firm*—Browdy and Neimark, P.L.L.C.

(57) ABSTRACT

The arrangement comprises a bottom part (1), which is mounted on the ski (3), and a top part (2), which can be fitted on the bottom part. The boot (4) can be connected to the top side (21) of the top part (2). The bottom part (1) comprises a base (13) which can be fastened on the body of the ski (3) and can be introduced into a correspondingly shaped central section (23) of the top part (2). In this central section (23), the base (13) is retained by means of a connecting devices (35). The central section of a flexible member (60) is retained between the base plate (10) and the body of the ski (3). This member (60) and the way it is secured on the ski are such that it acts as an automatically triggering brake.

14 Claims, 10 Drawing Sheets

3
67
19
613
17
1
13
16
621
60
18
65
5

1
17
13
611
621
65
612
613
67
623
622
10
5
3

38
37
36
13
75
76
17
78
16
72
70
231
73
71
131
B
12

DEVICE FOR LINKING A SPORTS EQUIPMENT WITH A SHOE

BACKGROUND OF THE INVENTION

1. Technical Field of the Invention

The present invention relates to an arrangement for connecting a piece of sports equipment to a boot.

Short skis for example, in particular those under 100 cm in length, count among the pieces of winter sports equipment which are increasingly being bought by inexperienced individuals. Such short skis should be very user-friendly, and this user-friendliness should be associated with safety. User-friendliness and safety, however, do not feature highly, if at all, in most products of this generic type. Arrangements which are intended for connecting a piece of sports equipment to a boot and are to be found on such pieces of equipment, which arrangements may also be referred to a bindings, are, in some cases, difficult to adapt to the skier's boot size, are not configured to avoid injury the event of a fall, have an adverse effect on the skiing performance as a result of the lack of flexibility of the stiff, short free ski length, often do not have any ski brake and, in some cases, force the skier into unnatural skiing postures.

2. Prior Art

The object of the present invention is to overcome the abovementioned disadvantages, and also further disadvantages, of the prior art.

OBJECT OF THE INVENTION

This object is achieved, according to the invention, in the case of the arrangement of the generic type mentioned in the introduction.

BRIEF DESCRIPTION OF THE DRAWINGS

Embodiments of the present invention are explained in more detail hereinbelow with reference to the attached drawings, in which.

DETAILED DESCRIPTION OF THE PREFERRED EMBODIMENTS OF THE INVENTION

Figure 1:
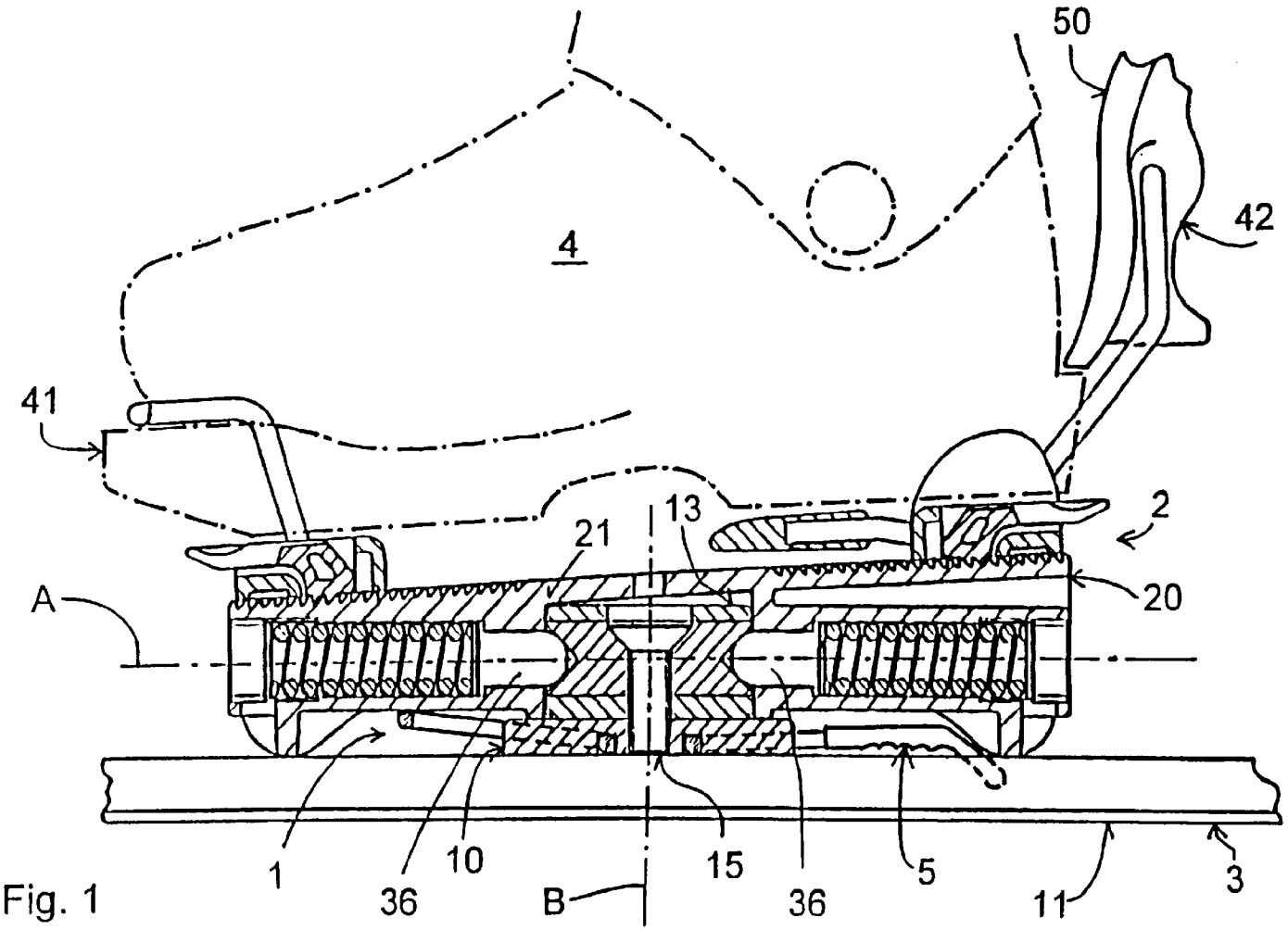
FIG. 1 shows, in a vertical longitudinal section, the present arrangement together with a brake and with a ski boot clamped on, the brake being illustrated in the stressed state.

The present arrangement (FIGS. 1 and 2) comprises a bottom part 1 and a top part 2, which are connected releasably to one another. The bottom part 1 of this arrangement can be fastened, via its underside, on the top side of a piece of sports equipment 3, for example of a ski. The top side of the top part 2 of this arrangement can be fastened on a boot 4, it being possible for this fastening to be releasable or even non-releasable. The arrangement has a longitudinal axis A which runs more or less horizontally and more or less parallel to the longitudinal direction of the elongate basic body 11 of the piece of sports equipment 3.

The bottom part 1 of the arrangement comprises a base plate 10, which in the present example has a more or less quadrilateral outline. Two of the mutually parallel sides or edges of this base plate 10 run at least more or less parallel to the longitudinal direction of the elongate basic body 11 of the piece of winter sports equipment 3. The base plate 10 may be fastened on the body 11 of the ski in a manner known per se, for example with the aid of screws (not illustrated).

A base 13 is arranged on the base plate 10. In the case illustrated, the base 13 is essentially in the form of a thick disk. In the case illustrated in FIGS. 1 and 2, this disk is made up of three sub-disks 131, 132 and 133 which are located one upon the other, are connected fixedly to one another and have cylindrical circumferential surfaces. The sub-disks 131, 132 and 133 may be made of a plastic and they are connected fixedly to one another, for example, by adhesive bonding or being welded together. The external diameters of the sub-disks 131 to 133 are more or less equal. The first sub-disk 131 is located directly on the base plate 10. Located on the top side of this first sub-disk 131 is the central disk 132 and, on the latter, the head disk 133. The sub-disks 131 to 133 are arranged one upon the other such that their cylindrical outer surfaces are aligned with one another. The outer sub-disks 131 and 133 are thinner than the central disk 132.

The respective sub-disk 131 to 133 has a central hole 12, the axes of said central holes 12 being located on a common axis B. A connection element 15 passes through the sub-disks 131 to 133. This connection element 15 may be a screw, a rivet or the like. In the case illustrated, the connection element 15 is configured as a screw which passes through the base 13 and is screwed into the base plate 10. The base 13 is thus fastened on the base plate 10, it being the intention for this fastening to be such that the base 13 is fastened on the base plate 10 such that it cannot be rotated about the axis B. The size of the diameters of the central holes 12 in the sub-disks 131 to 133 is adapted to the shape an size of the bolt and of the head of the screw 15.

Depressions 16 and 17 are made at two mutually opposite locations of the cylindrical circumferential surface 14 of the central disk 132 of the base 13. One of these depressions 16 is arranged at that location of the circumferential surface 14 of the central disk 132 which is directed towards the front region of the piece of sports equipment 3. The second of these depressions 17 is arranged at that location of the circumferential surface of the central disk 132 which is directed toward the heel region of the piece of sports equipment 3.

In the case illustrated, the wall of the respective depression 16, 17 is in the form of the lateral surface of a cone, the axes of these cones being located on a common line and a vertices of these cones being directed toward one another. The axes of such depression 16 and 17 are expediently located on the longitudinal axis A. The bottom of the respective cone, and thus also of the widest region of the depression 16, 17, is located in the region of the outer surface 14 of the central disk 132. The diameter of the abovementioned largest region of the depressions 16 and 17 is smaller than the thickness of height of the central disk 132. It is also possible, however, for the wall of the respective depression 16 or 17 to be in the form of a lateral surface of a spherical segment or the like.

Figure 3:
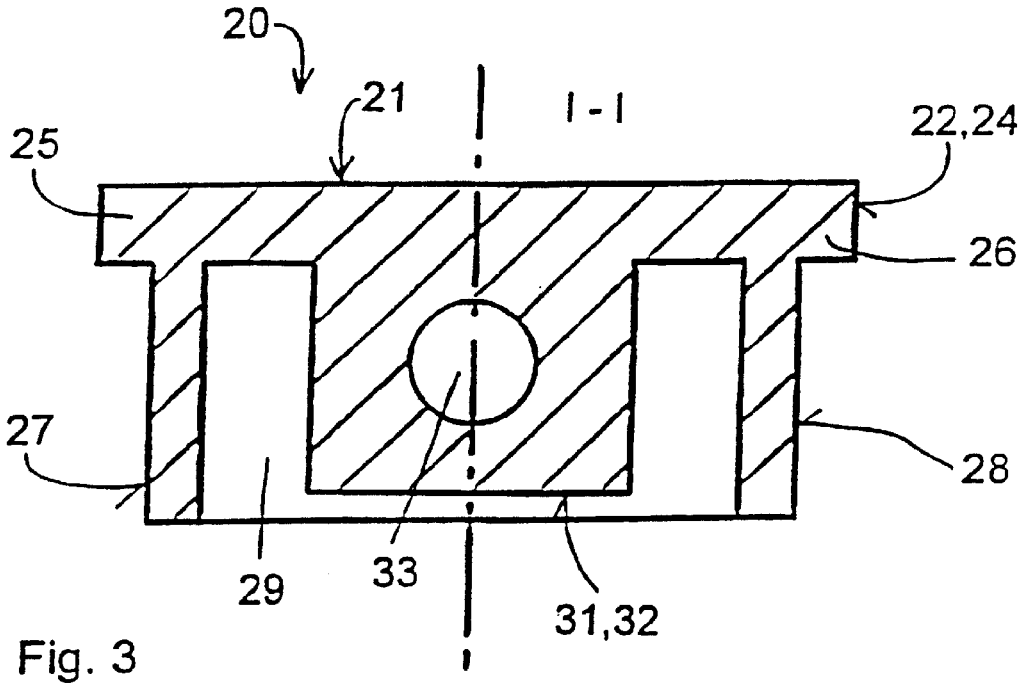
FIG. 3 shows a first section I—I through the basic body of the arrangement.
Figure 4:
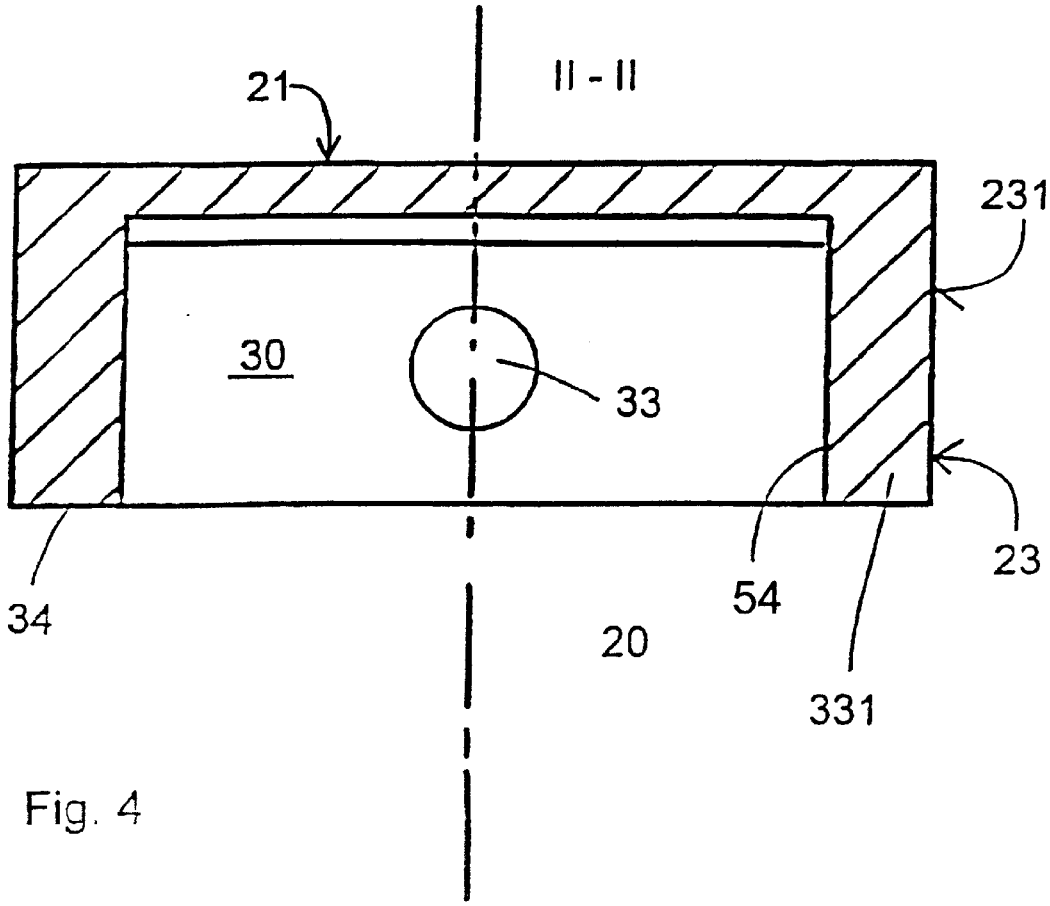
FIG. 4 shows a second section II—II through the basic body of the arrangement.

The top part 2 of the present arrangement comprises an elongate basic body 20, of which the length corresponds approximately to the length of a ski boot. FIG. 3 shows a section I—I, and FIG. 4 shows a section II—II, through the basic body 20 of the top part 2. The basic body 20 of the top part 2 comprises a front elongate section 22, a central and essentially round section 23 and a rear elongate section 24. The central section 23 has a housing 231 which is essentially in the form of a short tubular element. The longitudinal axis of this tubular element 231 runs vertically. The inner circumferential surface 54 of this housing 231 is intended and designed for accommodating the base 13. The respective elongate section 22, 24 are connected, at one end, to the outside of the housing 231 of the central section 23. The connection locations of the longitudinal sections 22 and 24 are located on mutually opposite sides of the central-section housing 231. The three basic-body sections 22 to 24 from a single piece, which is advantageously produced from a plastic.

The basic body 20 has an elongated base plate 21 which extends over all three of the abovementioned sections 22, 23 and 24 of the basic body 20. In the region of the longitudinal sections 22 and 24 of the basic body 20, essentially plate-like ribs 27 and 28 hang down from the underside of the base plate 21, and these ribs 27 and 28 likewise extend in the longitudinal direction A of the top part 2. The outer surface of the respective rib 27, 28 is spaced apart from the associated side edge of the base plate 21, with the result that border sections 25 and 26 of the base plate 21 project freely in the lateral direction here. The height of the ribs 27 and 28 is at its smallest in the vicinity of the central section 23 and increases in the direction of the end of the respective longitudinal section 22, 24. In each case one supporting protrusion 29 is formed in the region of the free end portion of the respective longitudinal section 22, 24, and supporting protrusion extending to the top side of the basic body 11 of the piece of sports equipment 3 and being supported on this top side.

An essentially longitudinal housing 31, 32 with a tubular interior 33 is respectively located between the ribs 27 and 28 of the respective longitudinal section 22, 24. The respective housing 31, 32 adjoins the underside of the base plate 21, the housing 31, 32 expediently being integral with the base plate 21. One of the mouths of the essentially tubular interior 33 in the housing 31, 32 is located in the free end wall 29 of the respective longitudinal section 22, 24. The other mouth of the continuous tubular interior 33 in the housing 31, 32 is located in the region of the central section 23 of the basic body 20 of the top part.

The central section 23 of the basic body 20 of the top part is designed, inter alia, for accommodating the base 13. For this purpose, the central section 23 has a space 30 designed for accommodating the base 13. This accommodating space 30 has an inner wall 54 which is in the form of the lateral surface of a short cylinder. The diameter of this inner wall 54 corresponds to the external diameter of the base 13. The height of the inner wall 54 corresponds to the height of the base 13, with the result that the base 13 can be accomplished in its entirety in the central section of the basic body 20 of the top part. On account of the base 13 being accommodated in this way, the central section 23 of the basic body 20 of the top part is wider than the longitudinal sections 22 and 24 of the basic body 20 of the top part. This largest width of the basic body 20 of the top part, however, is expediently smaller than the width of the basic body 11 of the sports equipment 3. The wall of the housing 30 of the central section 23 has a bottom and more or less annular end surface 34, via which this housing 30 rests on the top side of the base plate 10.

The top part 2 of the arrangement further comprises devices 35 for a releasable connection between this top part 2 of the arrangement and the base 13. In each case one of these devices 35 is assigned to one of the longitudinal sections 22 and 24 of the basic body 20 of the top part. The connecting device 35 comprises a bolt 36 which is arranged in that end portion of the tubular interior 33 in the longitudinal section 22, 24 which adjoins the central section 23. The tip of the bolt 36 projects into the interior of the accommodating housing 30 in the central section 23 and may be accommodated in one of the depressions 16 and 17 of the base 13. One account of the above described position of the depressions 16 and 17, the top part 2, when positioned on the base 13, always assumes a position parallel to the longitudinal direction of the piece of sports equipment 3 when the tips of the bolts 36 latch into the depressions 16 and 17.

One end of a compression spring 37, which in the present case is a helical spring, rests at the end of the bolt 36 which is directed away from the central section 23.

A screw 38, in the case illustrated in headless pin, is screwed into that mouth of the tubular cavity 33 which is located in the free end portion of the longitudinal section 22, 24. This screw 38 presses onto the other end portion of the compression spring 37. The screw 38 makes it possible to adjust the magnitude of the pressure acting on the bolt 36. The greater this pressure, the stronger is the grip of the base 13 in the accommodating space 30 of the central section 23.

Figures 5, 6:
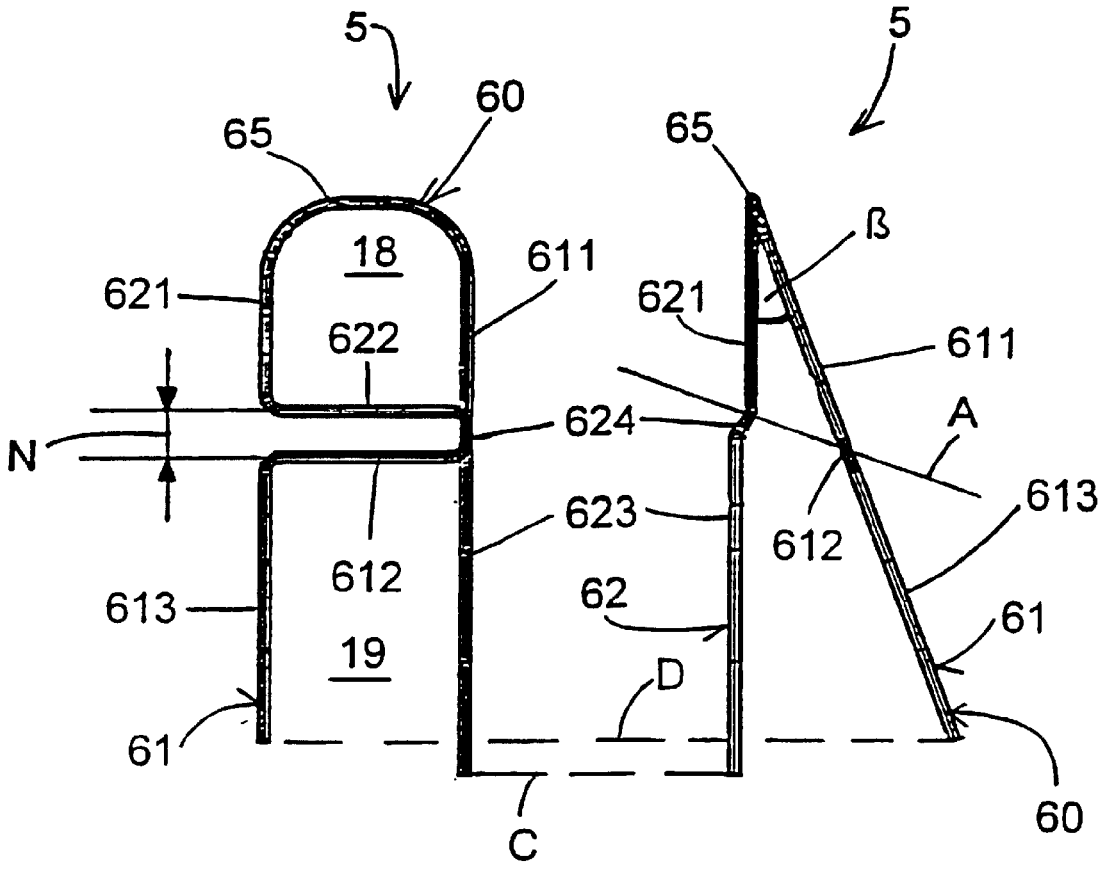
FIG. 5 shows a side view of the basic body of the brake from FIG. 1.
FIG. 6 shows a plan view of the basic body of the brake from FIG. 1.

In the event of the sports person falling, the top part 2 of the arrangement, which is coupled to the boot 4 by the fixing means, may be released from the central base 13 which, as is described, is fastened on a piece of sports equipment 3. It is thus possible for the sports person to lose the ski 3 in such a case. In order that this does not pose any risk to others, the ski 3 has to be braked. This is achieved by a brake or a stopper 5 which acts automatically. FIG. 5 shows a side view of the basic body 60 of such a brake 5. FIG. 6 shows a plan view of the base body 60.

The basic body 60 of the brake 5 is configured as a resilient member, it being possible for this basic body 60 to be a wire bracket made of spring steel. The basic body 60 of the brake 5 comprises two arms or legs 61 and 62 which are connected to one another at one end via one of their end portions. In the side view (FIG. 5), the legs 61 and 62 appear essentially as being rectilinear or straightened out. The legs 61 and 62 enclose an angle beta which is less than 90 degrees. The legs 61 and 62 thus form a V-shaped arrangement. The angle beta may be between 20 and 60 degrees and is expediently 25 degrees. In plan view (FIG. 6), the respective leg 61, 62 of the basic body 60 of the brake is essentially Z-shaped.

The first leg 61 of the resilient basic body 60 of the brake has two mutually parallel longitudinal sections 611 and 613 of the Z-shape. These longitudinal sections 611 and 613 run parallel to the longitudinal axis of said leg 61. The longitudinal sections 611 and 613 are connected to one another by a transverse section 612 of the leg 61. This transverse section 612 is located more or less at right angles to the parallel longitudinal sections 611 and 613 of this first leg 61 of the braking body.

The second leg 62 of the braking body likewise has two mutually parallel longitudinal sections 621 and 623 of the Z-shape. They run parallel to the longitudinal axis of the leg 62. These longitudinal sections 621 and 623 are connected to one another by a transverse section 622. The transverse section 622 is located more or less at right angles to the parallel longitudinal sections 621 and 623.

The front ends of the first longitudinal sections 611 and 621 of the legs 61 and 62 of the braking body are connected to one another by a transverse web 65. This connecting web 65 between the legs 61 and 62 is connected integrally, at one end, to the outer end of the first or top longitudinal section 611 of the first leg 61. At the other end, the connecting web 65 is connected integrally to the outer end of the first or top longitudinal section 621 of the second leg 62.

Two cutouts 8 and 9 are made in the underside of the base plate 10 of the bottom part 1 of the arrangement (FIGS. 1 and 2), to be precise advantageously beneath the base 13, and run more or less parallel to one another. These cutouts 8 and 9 open in the downward direction, i.e. in the direction of the basic body 11 of the piece of sports equipment 3, and they run transversely to the longitudinal axis A of the arrangement. One of the respective transverse sections or webs 612 and 622 of the legs 61 and 62 of the braking body is located in the respective cutout 8, 9. The web 622 of the second leg 62 of the braking body is located in the first or front cutout 8. The web 612 of the first leg 61 of the braking body is located in the second or rear cutout 9.

The longitudinal sections 623, 613 of the legs 61 and 62 serve as the levers which cause the braking action. These levers are positioned laterally on the ski and can be pivoted past the latter. The outer ends of the second longitudinal sections 613 and 623 of the legs 61 and 62 are free. As a result, the shape of the resilient member 60 of the brake is reminiscent of a figure eight which is open on one side. The free ends of the second longitudinal sections 613 and 623 are of different lengths. The position of these ends of the legs 61 and 62 is indicated by dashed lines C and D in FIGS. 5 and 6. The second longitudinal section 613 of the first leg 61 is shorter than the second longitudinal section 623 of the second leg 62. These second longitudinal sections 613 and 623 of the legs 61 and 62 are pressed into the snow, as braking levers, by the force stored in the basic body 60 of the brake 5.

The two braking sections 623 and 613 are essentially rectilinear. It is also possible, however, for them to be, for example, curved, bent or inflected. The ends of the braking sections 623 and 613 may be provided with suitable means or be shaped suitably in order to effect a better braking action upon contact with the snow. For this purpose the braking sections 623 and 613 are provided with braking claws 67, which are inflected (FIGS. 1, 2, 7 and 8).

The first longitudinal section 621 of the second leg 62 is shorter than the first longitudinal section 611 of the first leg 61. The transverse section 622 of the second leg 62 is thus located closer to the connecting web 65 than the transverse section 621 of the first leg 61. These mutually parallel transverse sections 612 and 622 of the legs 61 and 62 are spaced apart from one another by a distance N. This distance N is equal to the distance between the cutouts 8 and 9 in the base plate 10. It is thus possible to accommodate in each case one of the transverse sections 612 and 622 in one of the respective cutouts 8 and 9 of the base plate 10.

Figure 2:
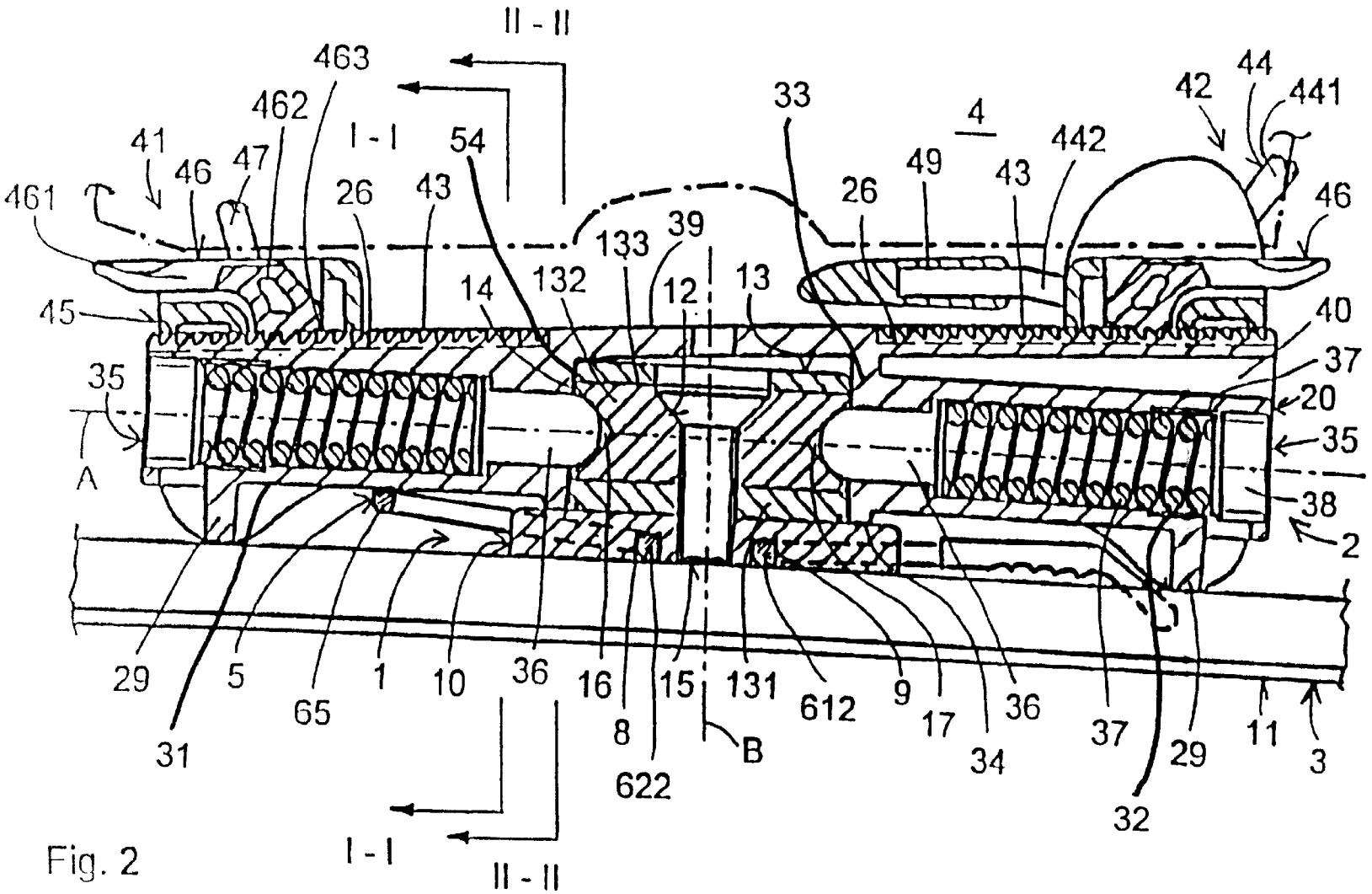
FIG. 2 shows an enlarged detail from FIG. 1.

The transverse sections or rotary sections 612 and 622 are located transversely, i.e. approximately at right angles, to the longitudinal direction of the ski 3 and are mounted rotatably with play in the cutouts 8 and 9 (FIGS. 1 and 2). When the base plate 10 has been mounted on the basic body 11 of the piece of winter sports equipment 3, then the transverse sections 612 and 622 are retained in the cutouts 8 and 9 of the basic body 11 of the piece of equipment 3. In order to fit the brake 5 on the piece of sports equipment 3, there is thus no need to drill holes in the basic body 11 of the piece of sports equipment 3.

The transverse webs 612 and 622 of the Z-shaped legs 61 and 62 are more or less of the same length, the length thereof corresponding to the width of the ski 8. This results in the distances between the longitudinal sections 611 and 613 of one resilient leg 61 and the longitudinal sections 621 and 623 of the other resilient leg 62 being equal and in these distances being somewhat greater than the width of the basic body 11 of the ski 3.

In plan view (FIG. 6), the second longitudinal section 623 of the second leg 62 appears to be a continuation of the first longitudinal section 611 of the first leg 61. This is not the case, however, as can be seen from the side view (FIG. 5) of the basic body 60 of the brake. As can be seen from FIGS. 5 and 6, the legs 61 and 62 cross one another. As has already been explained, the first longitudinal section 621 of the second leg 62 is shorter than the first longitudinal section 611 of the first leg 61. The transverse section 622 of the second leg 62 is thus located closer to the connecting web 65 than the transverse section 612 of the first leg 61. On the second leg 62, there is an initial section 624 of the second longitudinal section 623 which directly adjoins the transverse section 622 of this second leg 62 and is arranged behind (FIG. 6) a corresponding stretch N of the first longitudinal section 611 of the first leg 61. The longitudinal section 624 and the corresponding stretch of the first longitudinal section 611 of the first leg 61 thus overlap over the abovementioned stretch N.

In order that the basic body 60 of the brake can be compressed as flatly as possible between the top part 2 and the ski 3, the initial section 624 of the second longitudinal section 623 is angled away from the first leg 61 (FIG. 5), with the result that the transverse sections 612 and 622 may be located more or less in the same plane when the basic body 60 of the brake is compressed between the top part 2 and the ski 3. This makes it possible for the height of the arrangement to be kept small.

If the basic body 60 of the brake 5 is produced from a single piece of wire made of spring steel, then the individual sections of this basic body 60 merge one into the other by means of arcuate sections. This also applies to the transitions between the connecting web 65 and the first longitudinal sections 611 and 612 of the legs 61 and 62. Viewed as a whole, this results in the basic body 60 of the brake 5 approximately having the abovementioned shape of a figure eight which is open in the direction of the bottom end side of said member 60.

The top, closed half 18 (FIG. 6) of the resilient member 60 comprises the connecting section 65, the first longitudinal sections 611 and 621 of the legs 61 and 62 and the transverse section 622 of the second leg 62. The connecting web 65 forms the actual actuating part of the brake 5, as is described in more detail hereinbelow. By the transverse sections 612 and 622, which are mounted pivotably in the base plate 10, the top half or controlling half 18 of said brake 5 is connected to the bottom half or braking half 19. The bottom, open half 19 of said basic body 60 of the brake is bounded laterally by the braking levers 613 and 623. This bottom braking half 19 can come into contact with snow in order to produce the desired braking effect.

Figures 7, 8:
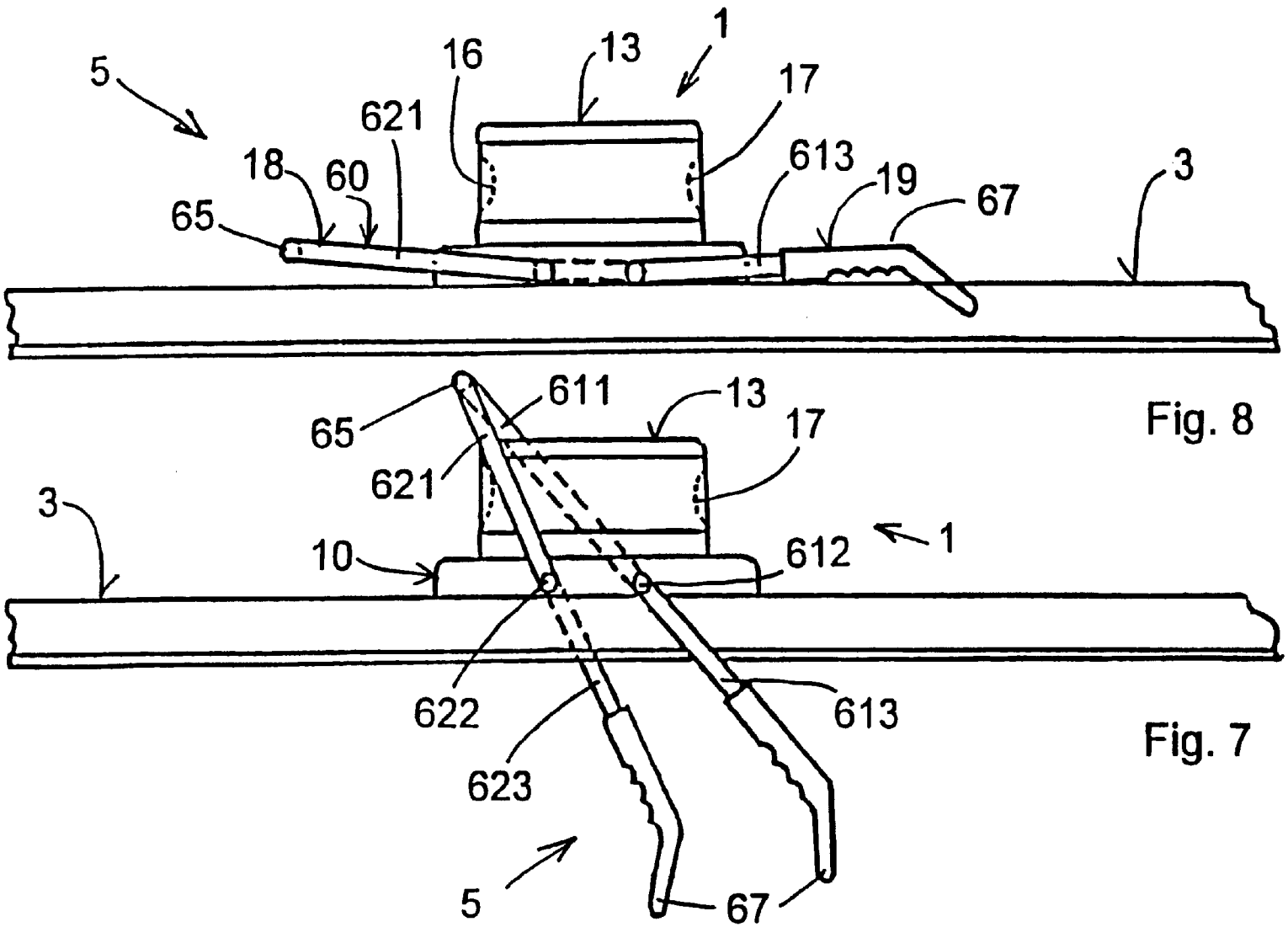
FIG. 7 shows, schematically, a side view of the brake from FIG. 1 in the state in which it is relieved of stressing.
FIG. 8 shows, schematically, a side view of the brake from FIG. 1 in the state in which it is relieved of stressing.

When the braking member 60 has been arranged on the ski 3, then the controlling half 18 of the resilient member 60 is located closer to the front tip of the ski 3 than the bottom half 19 of the resilient member 60. In this case, the transverse web 65 of the basic body 60 of the brake is located in front of the bottom part 1 of the present arrangement, to be precise at a first, relatively large distance (FIG. 7) from the surface of the basic body 11 of the ski. On account of the V-shape of the resilient member 60 which can be seen from FIG. 5, the resilient member is in a position in which it is still relieved of stressing, and is shown in FIG. 7. The position of the longitudinal axis A of the ski is indicated by a corresponding line A in FIG. 5, this showing the resilient member 60 in the state in which it is relieved of stressing. In this relieved state, the controlling half 18 runs steeply upward in an oblique manner in relation to the body 3 of the ski (FIG. 7) to be precise away from the ski 3. In this relieved state, the braking half 19 of the resilient member 60 runs, in contrast, steeply downward in an oblique manner.

As the top part 2 is positioned on the base 13, first of all the underside of the front longitudinal section 22 of the top part 2 comes to reset on the transverse web 65 of the controlling half 18 on the basic body 60 of the brake. As the top part 2 is moved further in the direction of the bottom part 1, the transverse web 65 of the brake 5 is automatically pressed further downward. Via the transverse sections 612 and 622, the movements of the controlling half 18 are transmitted to the braking half 19, to be precise such that the braking half 19 executes movements in the opposite direction to the controlling half 18. If the controlling half 18 moves downward, then the braking half 19 moves upward. In this case, on the one hand, the basic body 60 of the brake is prestressed onward and, on the other hand, the braking sections 613 and 623 are automatically pivoted upward (FIG. 8).

When the top part 2 has been positioned low enough on the base 13 for the bolts 36 of the top part 2 to latch into the depressions 15 and 16 of the base 13, then the controlling half 18 and the braking half 19 of the brake 5 run more or less parallel to the ski 3 (FIG. 1, 2 and 8). The controlling half 18 of the resilient member 60 is located here between the removable top part 2 and the ski 3. The height of the distance between the transverse web 65 of the controlling half 18 and the ski 3 is now smaller than the height of that distance which was mentioned in conjunction with FIG. 7.

As the resilient member 60 is transferred from its position in which it is originally relieved of stressing into its stressed position, the controlling half 18 of the resilient member 60 is deformed. This is because the angle beta between the legs 61 and 62 is reduced during the stressing operation. The distance between the transverse sections 612 and 622, however, remains unchanged. This is because the distance between the transverse sections 612 and 622 is given by the distance between the cutouts 8 and 9 in the base plate 10 and because the distance between the cutouts 8 and 9 in the base plate 10 cannot be changed. On account of the controlling half 18 being deformed in this way, stressing is built up in the individual sections of the resilient member 60. This stressing may be regarded as torsional stressing which attempts to move the controlling half 18 upward into the position in which it is relieved of stressing, or its rest position, and, accordingly to press the braking half 19 downward into the snow.

If the top part 2 of the arrangement is removed from the base 13, for example in the event of the sports person falling then the controlling half 18 of the brake 5 pivots upward on account of the abovementioned energy stored in the basic body, 60 of the brake. This results in the braking half 19 being pivoted downward, as a result of which the desired braking action is initiated. In the illustration according to FIG. 7, the sections 623 and 613 of the braking half 19 are located in their active braking position and, together with the claws 67 fitted thereon, extend steeply downward in an oblique manner, to be precise to beneath the underside of the ski 3.

The righting moment of the bracket 60 is such that effective braking action takes place upon contact of the claws 67 with the snow. If the righting maximum is accidentally exceeded, the brake 5 is not damaged in any way because the spring-steel bracket 60, as a result of its sling-like, elastic configuration, can also be moved into a negative extreme position. This is advantageous specifically in the case of the short skis with a double upturn at the front and rear, which can slide in both directions. In the event of a fall, the resulting rotary and centrifugal forces make it possible to overcome the spring force of the pressure-exerting bolts 36. The top part 2 separates from the bottom part 1 in the process, with the result that the ski 3 is separated from the skier when he/she falls.

The base plate 20 of the top part 2 of the present arrangement is of wedge-like design (FIGS. 1 and 2). The underside of the base plate 20 of the top part is configured such that it runs more or less parallel to the longitudinal axis A of the arrangement. The top side or the top surface 39 (FIG. 2) of the base plate 20, in contrast, is inclined in relation to the longitudinal axis A. This inclination may be just a few degrees, and is oriented such that the top side 39 is inclined forward. In the heel region of the base plate 20, where the distance between the underside and the top side 39 of the base plate 20 is already considerable, there may be a wedge-shaped cutout 40 in the material of the top part 2, said cutout opening in the heel region of the base plate 20 and extending virtually as far as the central section 23 of the top part 2.

Arranged in the region of the end portions of the top part 2 are means which are intended for connecting the boot 4 to the present arrangement and are fitted in a displaceable and arrestable manner on the top part 2. At the front there are means 41 for securing the toe of the boot and at the rear there are means 42 for securing the heel of the boot. Those end sections of the basic body 20 which retain these means 41 and 42 are provided with toothing formations 43 which are made in the top side 39 of the basic body 20. At least in the region of these toothing formations 43, the already described border strips 25 and 26 extend on the side surfaces of the longitudinal sections 22 and 24.

The respective fastening means 41, 42 each comprise a basic block 45, in the underside of which a longitudinal cutout is made. This cutout is of more or less C-shaped cross section and is shaped such that the basic block 45 is pushed onto the relevant end portion of the base plate 20 and can be moved along the end portion more or less without play. The respective border strip 25, 26 is located in one of the more or less U-shaped end portions of the C-profile, with the result that these end portions engage behind the border strips 25 and 26 and retain the basic block 45 in a longitudinally displaceable manner on the top part 2.

An arresting device is provided, and this allows the position of the basic block 45 to be changed and arrested. A vertically running through-passage is made in the central region of the width of the respective basic block 45, an arresting lever 46 being mounted pivotably in said through passage. This arresting lever 46 has a first elongate section 461 which is located in a bed configured in the top side of the block 45, with the result that the surface of said longitudinal section 461 is aligned with the surface of the basic block 45. The free end of said longitudinal section 461 projects horizontally out of the basic block 45 in the outward direction.

The opposite end portion of the arresting lever 46 has a portion 462 which is thickened in the vertical direction, the cross section of this portion being approximately triangular. The corner 463 right at the front of this thickening 462 is supported pivotably in the basic block 45. That surface of the thickening 462 which is located opposite the toothing formation 43 on the top part 2 is provided with corresponding teeth, which can engage with the abovementioned toothing formation 43. If the basic block 45 is to be adjusted and arrested in the new position, then the elongate section 461 of the arresting lever 46 is raised until the teeth of the arresting lever 46 disengage from the toothing formation 43. It is then possible to adjust a new position of the basic block 45. If the longitudinal section 461 of the arresting lever 46 is pressed downward, then the teeth on the latter engage with the touching formation 43 again. This arresting device 46 is also located on the basic block 45 of the heel region. In this case, however, the longitudinal section 461 of the arresting lever 46 projects out of the block 45 in the rearward direction.

A bracket 47 which is known per se is mounted pivotably on the basic block 45 of the front fastening means 41, said bracket being intended and designed for securing the sole in the region of the toe of the boot. A device 48 which is known per se and is intended for clamping in the heel of the boot is fitted pivotably on the basic block 45 of the rear fastening means 42.

The rear coupling device 42 has an integrated "step-in" device which is designed as a straightforward two-armed lever 44 with a pedal plate 49 and is intended for the semiautomatic locking of the boot 4 in the binding 2 as the skier steps into this binding 2. A first arm 49 of the pedal lever 49 corresponds to the bracket 47 of the front fastening means 41, and this arm 491 bears a clamping lever 50 which is known per se and is intended for acting on the top border of the sole in the heel region. The other arm 492 of the two-armed lever 44 projects away from the basic block 45 of said rear coupling device 42, to be precise more or less horizontally in the direction of the center of the top part 2. The pedal plate 49 is mounted at the free end of said arm 492 by suitable engagement or a suitable connection. With a boot 4 fixed in the binding (FIGS. 1 and 2) the pedal plate 49 is aligned more or less parallel to the top surface 39 of the binding plate 2 and transmits the weight to the two-armed lever 44 and thus also to the clamping lever 50, which fixes the boot 4 by firm engagement.

As a result of the small base surface of the base plate 10, that section of the basic body 11 of the ski which is stiffened by the binding being mounted is very short. The thus short base plate 10 is also advantageous in short skis, which, as the name itself suggests, are short. In addition, in the state in which it is fitted on the ski 3 or on the base 13, the top part 2 of the arrangement is inclined forward in the skiing direction, as a result of which the skier can lean forward better and the position of the center of gravity is thus also more favorable. This improves, in turn, the skiing performance.

Figures 9, 10:
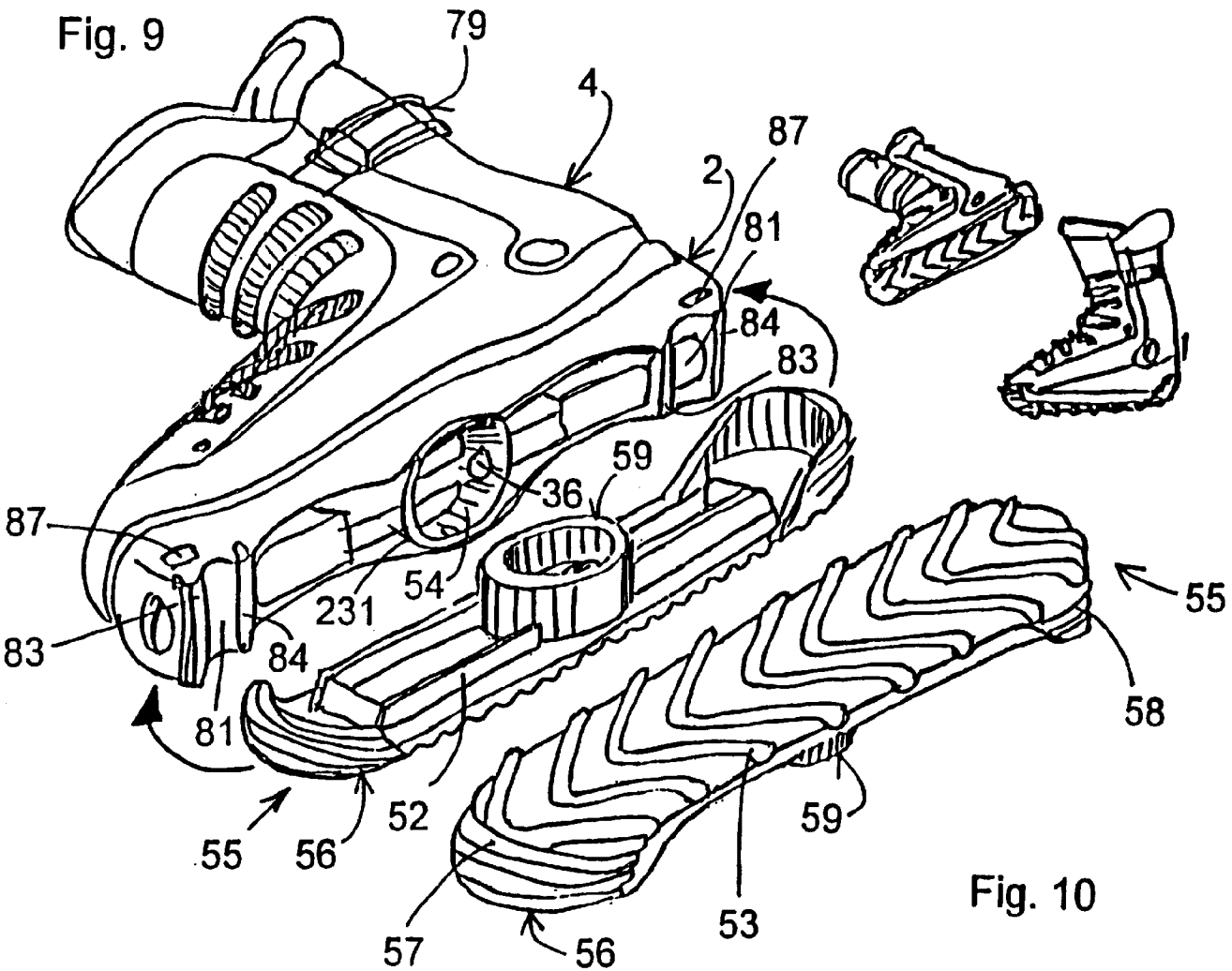
FIG. 9 shows, in perspective, a boot with the basic body of the present arrangement fitted thereon.
FIG. 10 shows, in perspective and from beneath, a protective sole of the present arrangement.
Figure 11:
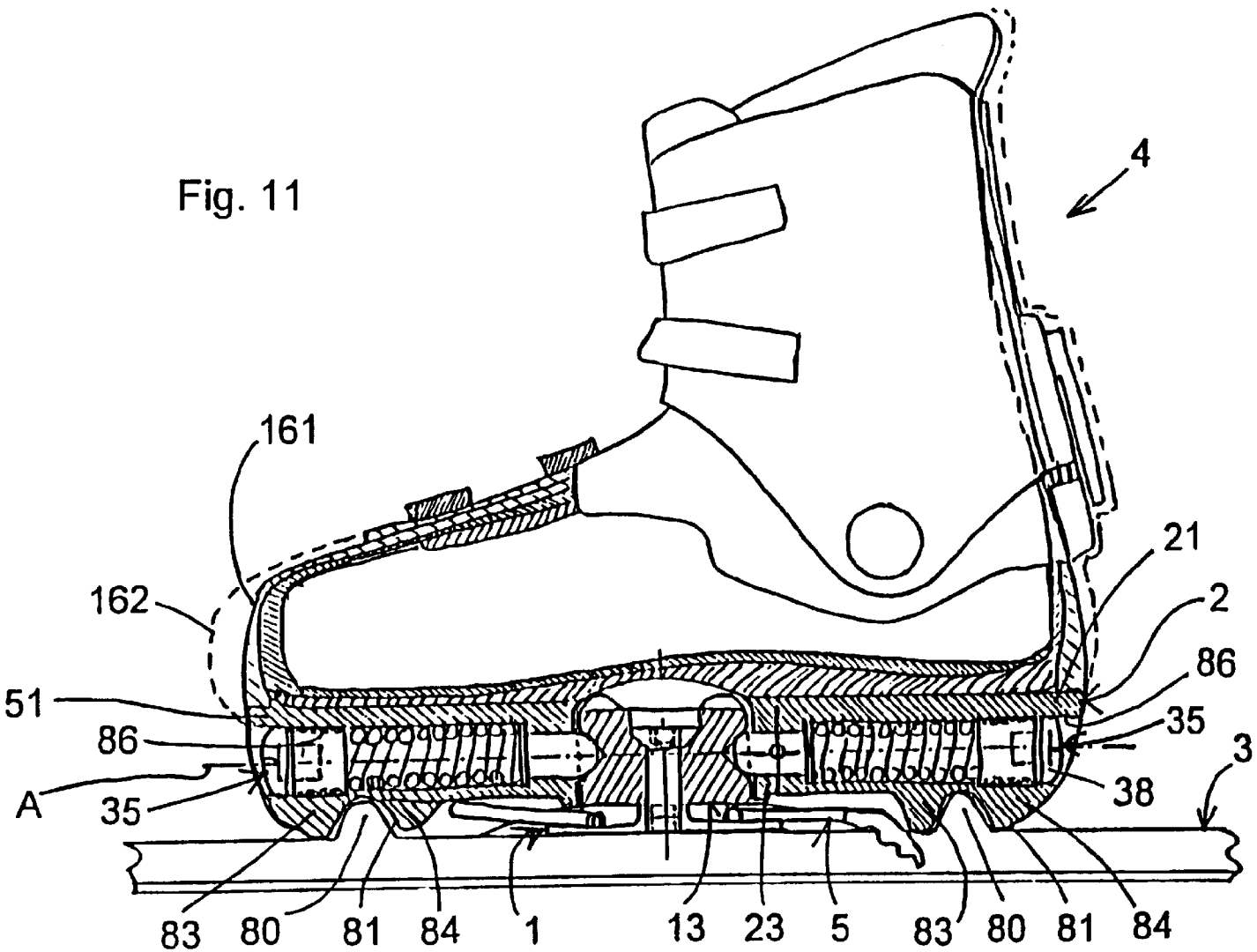
FIG. 11 shows a vertical section of the arrangement corresponding to FIG. 9.

Described above is a type of means 41 and 42 which makes it possible for the piece of sports equipment 3, which may also be a snowboard or the like, to be connected to the sports person's boot 4. The use of such connecting means is associated with some problems. In order to eliminate these problems, the top part 2 of the present arrangement is connected fixedly to the boot 4. Such configurations of the present arrangement are illustrated in FIGS. 9 to 12. FIG 9 shows the thus modified boot 4 in perspective. FIG. 11 shows a thus modified boot in vertical section. It is possible for the top part 2 to be adhesively bonded, welded or fastened in some other way on the underside of the thick and stiff sole of the boot 4 which is conventional for ski boots. Since, however, the top part 2 is itself sufficiently stiff, it may be connected to a boot which has a thin and possibly even comparatively soft sole 51 (FIG. 11). If use is made of such an arrangement 2, one places a thus modified boot 4 directly onto the bottom part 1 of the arrangement, to be precise until the bolts 36 latch the base 13 of the bottom part 1. The ski boot 4 has a so-called rear-entry system 79 which is known per se and makes it possible for the sports person to be able to step into the boot without having to actuate the clasps of the boot.

In order for the sensitive parts of the top part 2, which is fitted on the boot 4, to be protected against damage and/or soiling, a type of protective sole 55 is provided. This protective sole 55 is illustrated in perspective in FIG. 9 together with the boot 4. FIG. 10 illustrates this protective sole 55 in perspective from beneath.

The protective sole 55 has an elongate and flat basic body 56 which may be made, in principle, of a soft material, e.g. of a plastic or rubber, integrally formed at the front of the basic body 56 of this sole 55 is a front protective bead 57, which projects up from the basic body 56. This protective bead 57 is configured on the inside such that it fits onto the front portion of the part 2 from the front and is adapted, if appropriate, to the unevennesses of this front portion of the top part, or even fits into the same. This guarantees, or at least improves, the attachment of the toe portion of the protective sole 55 to the top 2. Located in the heel region of the protective sole is a rear protective bead 58, to which essentially the same applied as to the front protective bead 57.

Arranged in the central region of the basic body 56 of the protective sole 55 is a mating element 59, which likewise extends up from the basic body 56 of the protective sole 55. The outer dimensions of this mating element 59 correspond to the inner dimensions of the interior 54, which is provided in the central section 23 of the top part 2 for accommodating the base 13 of the bottom part 1. Since the bolts 36 always project onto said accommodating space 54 of the central section 23, they can clamp the mating element 59 between them and thus further improve the way in which the protective sole 55 is secured on the boot 4. The top side of the basic body 56 of the sole is provided with at least one stiffening rib 52 which extends in the central region of the length of the basic body 56 of the sole and stiffens the same. The mating element 59 projects up out of this rib 52. The top side of this rib 52 may be adapted to the shape of the relevant section of the top part 2, with the result that the rib 52 fills the unevennesses of the underside of the top part 2. The underside of the basic body 56 of the protective sole 55 may be provided with a pattern 53 (FIG. 10) which is known per se and reduces the risk of slipping on smooth surfaces.

While the present arrangement is operative, two types of force act on the base 13. The first force attempts to pull the base 13 out of the top part 2. During turning, the top part 2 then attempts to rotate about the axis B (FIG. 2) in relation to the base 13. The first-mentioned force is smaller than the second force because the top part 2 usually only presses onto the bottom part 1. It is also the case that the bottom part 1 is occasionally subjected to pulling, namely when the ski 3 has been relieved of loading and thus attempting to move away from the boot 4. The magnitude of this first force is determined essentially by the weight of the ski 3. The second force, which may also be referred to as a rotary force or torque, can achieve quite considerable values, depending on the skiing mode.

In order to prevent the sports person from losing the ski during skiing, the helical spring 37 has to subject the bolt 36 to some pressure. This may cause problems when one steps out of the ski 3. In order to eliminate these problems, a device 70, which is mentioned and designed for actuating at least one of the bolts 36, is provided.

Figure 12:
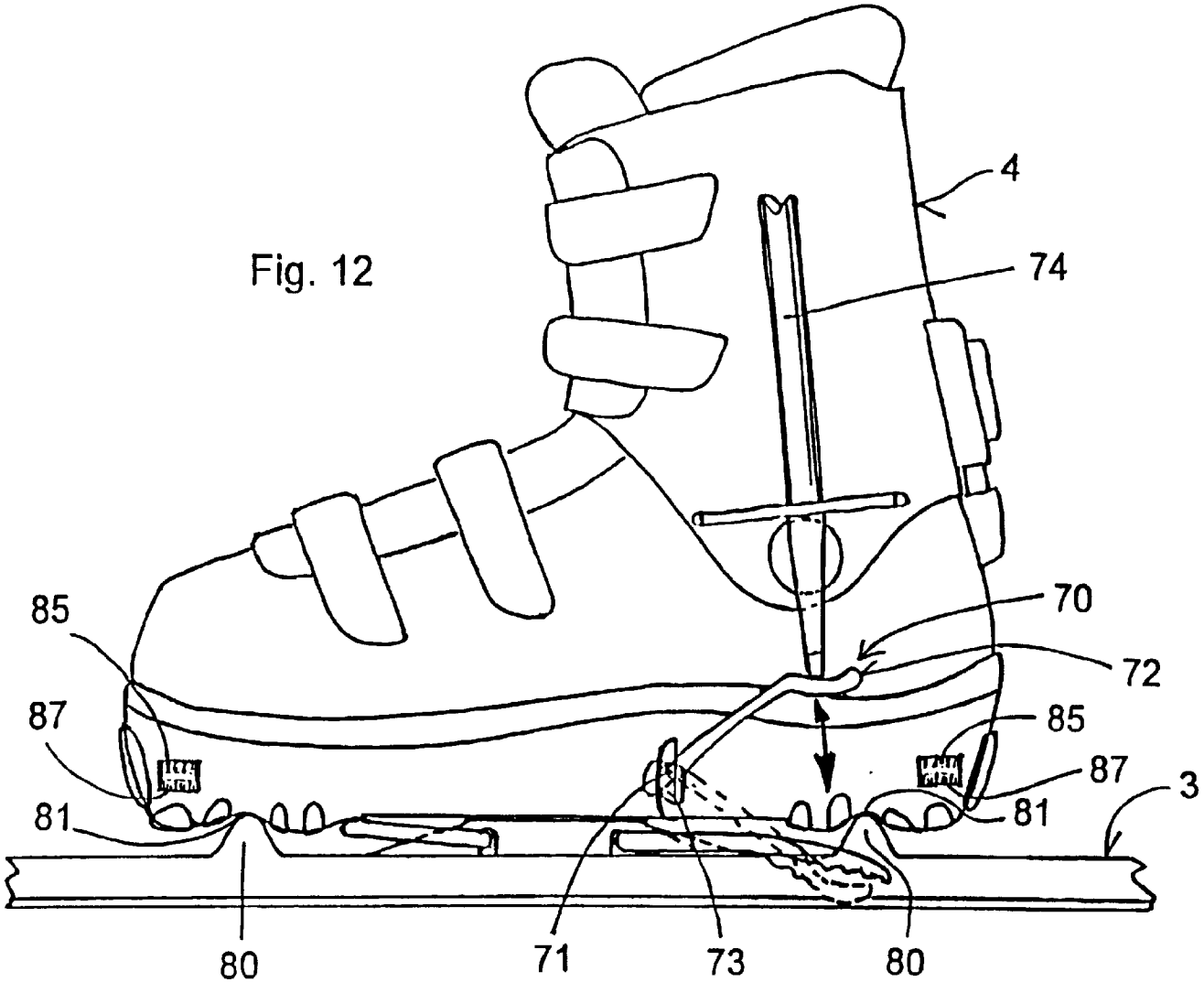
FIG. 12 shows a side view of a further configuration of the present arrangement.
Figures 13, 14, 15, 16:
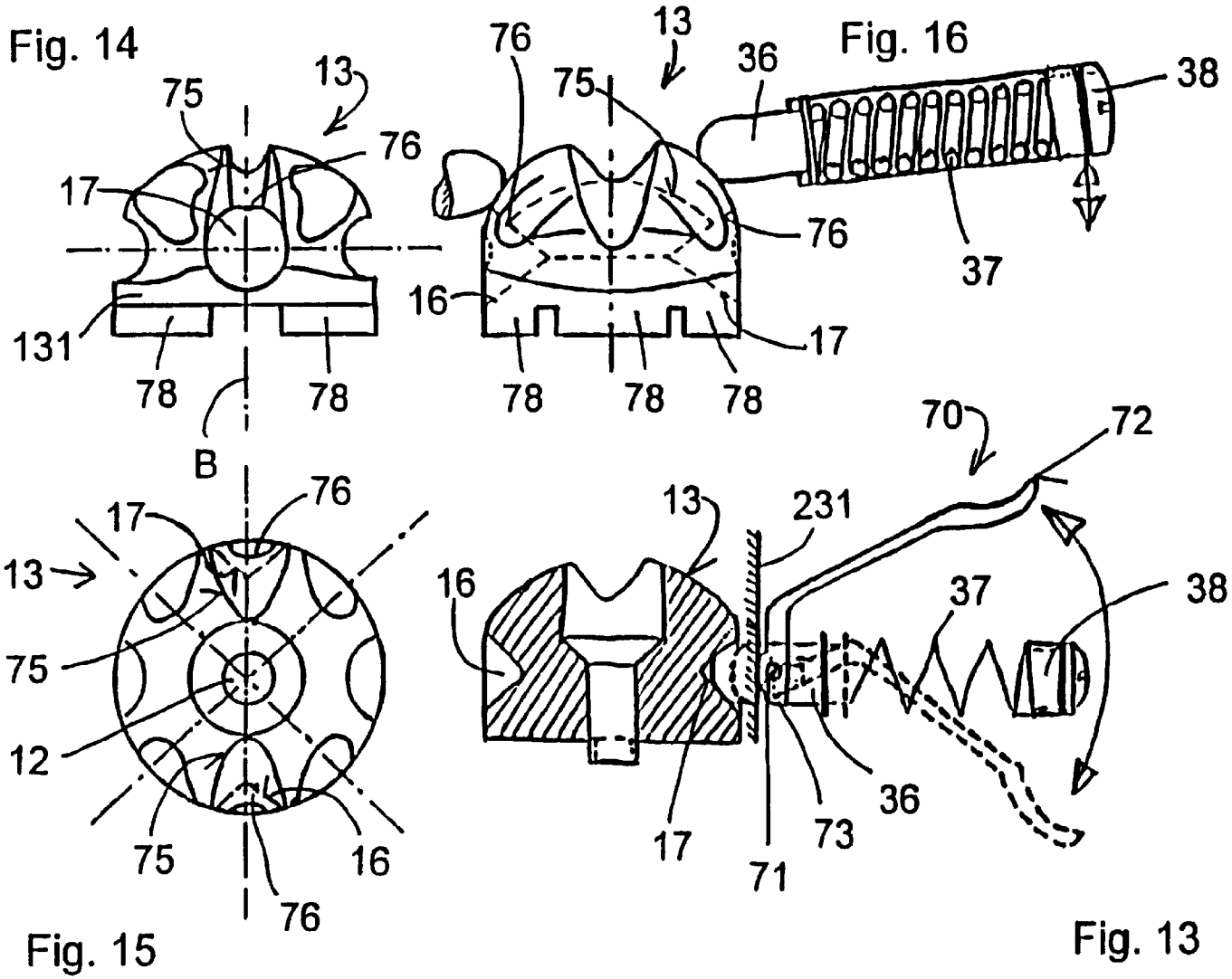
FIG. 13 shows a kinematic diagram of a device on the arrangement from FIG. 12.
FIG. 14 shows a first side view of a base of the present arrangement.
FIG. 15 shows a plan view of the base from FIG. 14.
FIG. 16 shows a second side view of the base from FIG. 14, this view having been rotated through 90 degrees in relation to the view in FIG. 14.

FIG. 12 illustrates the device 70 for actuating the bolt 36 in conjunction with the ski 3 and with the boot 4. FIG. 13 represents the kinematic diagram of this device 70. A more or less horizontally running pin 71 passes through one of the pressure-exerting bolts 36. An actuating layer 72 is articulated on this pin 71, with the result that this lever can be pivoted about the pin 71. In the region of the articulating location 71, or therebeneath, the lever 72 has a pressure-exerting portion 73, via which the lever 72 may be supported on the outside of the housing 231 of the central portion 23 of the top part 2. When the outer leg of the lever 72 is actuated or pressed downward, for example with the aid of a ski stick 74 (FIG. 12), then the pressure-exerting section 73 of the actuating lever 72 is first of all supported on the outer surface of the rigid housing 231. As the downward movement of the first arm 72 continues, the pressure-exerting bolt 36 is pressed back counter to the action of the spring 37. This reduces that force by which the bolts 36 act on the base 13 in the bottom part 1, which makes it considerably easier to step out of the binding.

As has already been explained, it is possible, in some circumstances, to achieve extremely high values for the torque of the top part 2 in relation to the base 13. In order to withstand such forces, and nevertheless to make it as easy as possible to step into the binding and step out of the same, it is necessary for the base 13 to be configured expediently. FIGS. 14 to 16 show such an expedient configuration of the base 13. FIG. 14 shows a first side view of this configuration of the base 13. FIG. 15 shows a plan view of the base 13. FIG. 16 shows a second side view of the base 13, in which case the base 13 has been rotated through 90 degrees in relation to the base 13 in FIG. 14.

The bottom plate 131 of the basic body of the base 13 is provided with vertically projecting ribs 78 which fit into corresponding depressions (not illustrated) in the top side of the base plate 10 of the bottom part 1. Such ribs 78 ensure that the base 13 cannot be rotated in relation to the ski 3.

The depression 16 and 17 in the circumferential surface of the base 13 are to be as deep as possible in order that the force which prevents the top part 2 from pivoting in relation to the base 13 is as large as possible. This alone, however, would make it difficult to step out of the binding, i.e. to pull the bolts 36 out of the depressions 16 and 17. This problem can be solved in that the depth of the borders of the depressions 16 and 17 differs in different directions. It is possible to arrange in front of the respective depressions 16, 17 a sliding groove 75 which runs in a meridian direction of the base 13. In the case illustrated, a sliding groove 75 (FIG. 16) is arranged in front of each of the depressions 16 and 17. The respective groove 75 extends from the center of the top side of the basic body of the base into the respective depression 16, 17, and in the process this groove 75 cuts into the section 76, located beneath, of the border edge of the depression 16, 17. This section 76 of the border edge of the depression 16, 17 is thus at a lower level, in the region of the sliding groove 75, than the rest of the border edge of the depressions 16 and 17. The abovementioned section 76 of the border edge 75 of the depressions, moreover, is located closer to the axis A of the base 13. Less force is thus needed if it is desired to pull the bolts 36 away from the base 13 in the direction of the axis B, i.e. through the sliding grooves 75, than if it is desired to rotate or pivot the top part 2 together with the pressure exerting bolts 36 about the axis B. FIG. 16 shows, inter alia, how one of the pressure-exerting bolts 36 moves through the sliding groove 75.

A further way of overcoming the abovementioned problem may be provided by tooth-like protrusions 80 (FIGS. 11 and 12) on the top side of the basic body of the ski. In each case one such protrusion 80 may be arranged on the body 3 of the ski in the region of the toe of the boot and of the heel of the boot. The longitudinal direction of the protrusion 80 is located perpendicularly to the longitudinal direction A of the present arrangement, it being possible for the protrusion 60 to extend over virtually the entire width of the body 3 of the ski. The vertex region of such protrusions 80 is rounded in order to avoid damage. A depression 81 (FIG. 9) is made on the bottom side, in the free end region of the respective longitudinal section 22, 24, one of the protrusions 80 fitting into said depression. The cross section of this depression 81 and that dimension of this depression 81 which runs perpendicularly to the longitudinal axis A correspond to the tooth-like protrusion 80 such that the latter fits into the depression 81 over the largest possible surface area. In the example illustrated, the depression 81 is located between two accumulations 83 and 84 of material which project out of the underside of the longitudinal sections 22 and 24 of the top part 2.

The screws 38 have a cylindrical section 86 (FIG. 11), which adjoins the inside of the screw head at one end. At least one scale 85 is configured on the outside of this cylinder section 86. Provided in the relevant region of the end portion of the longitudinal sections 22 and 24 is a window 87 (FIGS. 9 and 12) through which it is possible to see the respective scale 85. The window 87 is arranged in at least one of the side walls of the relevant longitudinal section 22, 24. The scales 85 are configured such that they indicate the pressure by which the screw 38 acts on the pressure-exerting bolt 36.

The top part 2 is expediently of the same length for all boot sizes, which constitutes a further simplification in the configuration of the ski binding. This fact is illustrated in FIG. 11 in that different lengths of the boot uppers 161, 162, etc. are depicted here.

Figures 17, 18:
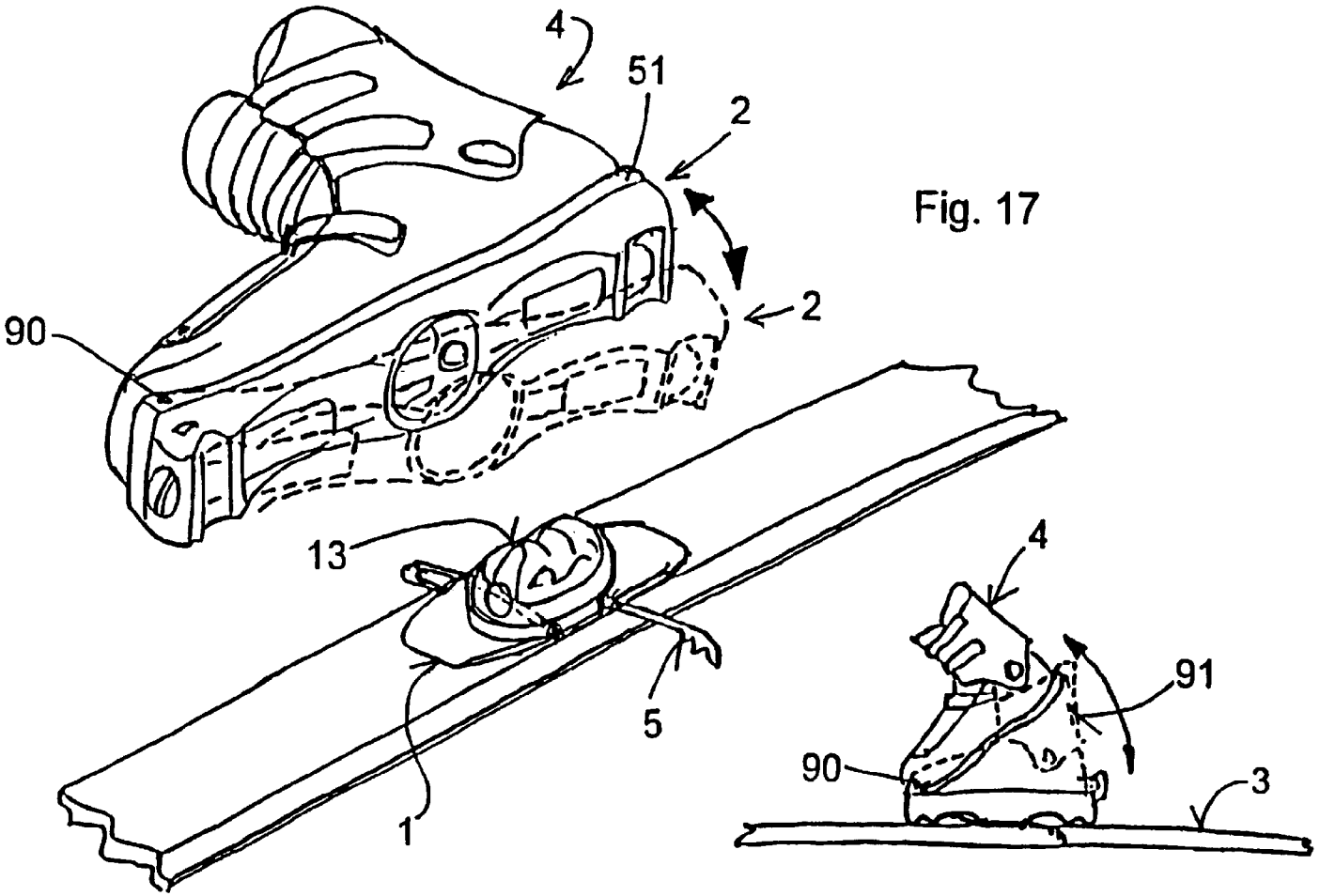
FIG. 17 shows, in perspective, a further configuration of the present arrangement which can be used on cross-country skis.
FIG. 18 shows a side view of the arrangement according to FIG. 17.

FIG. 17 shows, in perspective, a further configuration of the present arrangement, which can be used on cross-country skis. The top part 2 of the arrangement is connected to the boot 4 with the aid of a hinge 90 which is accommodated in the sole 51 of the boot 4, to be precise in the region of the toe of the boot. The hinge 90 runs transversely to the longitudinal direction A of the arrangement. FIG. 17 indicates by dashed lines how the top part 2 can be pivoted away from the boot 4 with the aid of the hinge 90. The top part 2 of the arrangement may be positioned on the base 13 of the bottom pat 1 in the manner described above.

FIG. 18 indicates a device 91 which is known from the conventional bindings for cross-country skis and is intended for limiting the pivoting region of the boot 4 about the hinge 90. The first end portion of this limiting device 91 may be connected to the top part 2, which is seated on the ski 3. The second end portion of the limiting device 91 is connected to that section of the sole 51 on the boot 4 which is located in the heel region. FIG. 18 shows the position of the boot 4 while the arrangement is operative, when the boot 4 is located in its raised position.

What is claimed is:

1. An arrangement for connecting a piece of sports equipment (3) to a boot (4), said arrangement comprising:

means for a releasable connection between said sports equipment (3) and a sole (2) of the boot (4) wherein a space (30) is provided at a middle section (23) of the sole (2), the space (30) opening downwardly and having a substantially cylindrical shaped interior surface (54);

a base (13) secured on the sports equipment (3), the base (13) having a substantially cylindrical shaped peripheral area, a diameter of the peripheral area corresponding to the diameter of an interior area (54) of the space (30), so that the base (13) fits into the space (30) and the boot (4) can rotate or pivot around an axis B of the base (13);

depressions (16,17) made at two diametrically opposite locations on an outer surface of the base (13);

connecting devices (35) provided at two diametrically opposite locations in the sole (2), so that the connecting devices (35) can respectively latch into the depressions (16,17);

a free end portion of the base body (13) being rounded, and at least one sliding groove (75) running in a meridian direction of the rounded free end portion, wherein the sliding groove (75) ends in one of said depressions (16,17).

2. An arrangement as defined in claim 1, wherein the sliding groove (75) extends from a center of a top side of the base (13) into the corresponding depression (16,17) located beneath the groove (75) cutting into a section (76) located beneath a border edge of the depression (16,17), wherein the section of the of the depression (16,17) is at a lower level in a region of the sliding groove (75) than in a remaining part of a border edge of the depression (16,17) and is closer to the axis B of the bease (13) than the remaining part of the border edge.

3. An arrangement as claimed in claim 1, wherein the sole (2) has an elongated basic body (20), the basic body (20) having two longitudinal sections (22, 24) located one behind the other and a central section (23) arranged therebetween, wherein the longitudinal sections (22, 24) butt against the central section (23) of the basic body (20), the space (30) being located in the central section (23) of the basic body (20), a tubular cavity (33) being carried out in each of the longitudinal sections (22, 24), one end portion of each of the tubular cavities (33) opening into the space (30) so that an interior opening or mouth of the tubular cavities (33) communicates with the interior area (54) of the space (30), wherein the connecting devices (35) are respectively accommodated in the tubular cavities (33).

4. An arrangement as claimed in claim 3, wherein each of the connecting devices (35) comprises a bolt (36) which is placed in a portion of a corresponding tubular cavity (33) adjoining the space (30), a screw (38) engaged in the tubular cavity (33), the screw (38) being placed at an outer end (29) of the tubular cavity (33), each of the connecting devices (35) also having a pressure-exerting spring (37) which is engaged in the tubular cavity (33) and placed between the pressure-exerting bolt (36) and the screw (38).

5. An arrangement as claimed in claim 4, wherein each of the screws (38) has a cylindrical section (86), at least one scale (85) being configured on an outside of this cylindrical section (86) and a window (87) provided in a relevant region of the end portion of the longitudinal sections (22,24) through which it is possible to see the scale (85).

6. An arrangement as claimed in claim 1, wherein a device (70) is provided, which reduces or temporarily eliminates the action to which the base (13) is subjected by the connecting device (35).

7. An arrangement as claimed in claim 1, wherein the base (13) is substantially in the form of a thick disk, the thick disc having at least a lower disk (131) and an upper disk (133) which lay one on the other and which are connected to each other, the upper disk (133) being a rounded portion and the sliding groove (75) being located on the rounded portion of the upper disc (133).

8. An arrangement as claimed in claim 7, wherein the lower disk (131) has vertically running ribs (78) wherein the ribs (78) fit into corresponding depressions which are located on the sporting device (3).

9. An arrangement as claimed in claim 7, wherein the base (13) is made up of three sub-disks (131, 132, 133) which are located one upon the other, which are connected fixedly to one another and which have cylindrical circumferential surfaces with substantially equal external diameters, so that the cylindrical outer surfaces are aligned with one another.

10. An arrangement as claimed in claim 1, wherein a base plate (10) is placed between the piece of sports equipment (3) and the base (13) and a brake (5) is mounted in the base plate (10).

11. An arrangement as claimed in claim 10, wherein the brake (5) comprises a resilient basic body (60), wherein the resilient basic body is essentially V-shaped, legs (61, 62) of the resilient basic body (60) crossing on another, a crossover location is being clamped pivotally between the bottom part (1) and the body of the ski (3), in that the basic body (60) has a control section (18) and a braking section (19) and in that the position of the control section (18) and thus also of the braking section (19) can be controlled by the sole (2).

12. An arrangement as claimed in claim 1, wherein a device (70) for actuating the bolt (36) is provided, the device having a substantially horizontally running pin (71) which passes through a pressure-exerting bolt (36), an actuating lever (72) being articulated on said pin (71), a pressure-exerting portion (73) on the lever (72) being placed in a region of the articulating pin (71) or there beneath and the lever (72) being shaped so that the lever can be actuated by a ski pole.

13. An arrangement as claimed in claim 1, wherein a first one of the depressions is arranged at a first location on the outer surface (14) of the base (13) which is directed towards a front region of the piece of sports equipment (3), a second one of the depressions (17) being at a second location of the outer surface (14) of the base (13) which is directed toward a heel region of the piece of sports equipment (3), a wall of each of the depressions (16,17) being in the form of a lateral surface of a cone, wherein each of the axis of the cones are located on a common line and vertices of the cones are directed toward one another, in that the axis of the depressions (16,17) being located on the longitudinal axis A of the arrangement or parallel to the longitudinal axis A, a bottom of the cones and a widest region of the depressions (16,17) being located in the region of the outer surface (14) of the base (13), a diameter of the widest region of the depressions (16,17) corresponding to the diameter of the connecting devices (36), or the wall of the respective depression (16;17) has a form of a lateral surface of a spherical segment.

14. An arrangement as claimed in claim 13, wherein the depressions (16,17) in the outer surface (14) of the base (13) so that a force which prevents the sole (2) from pivoting in relation to the base (13) is as large as possible, a depth of borders of the depressions (16,17) differing in different directions, a sliding groove (75), which runs in a meridian direction of the base (13), being arranged in front of each of the depressions (16,17), the respective sliding groove 75 extending from the center of a top side of the base (13) into the respective depression (16,17) and cutting into a section (76), located beneath a edge of the depression (16,17), the section (76) of the border edge of the depression (16,17) being at a lower level in the region of the sliding groove (75) than the rest of the border edge of the depressions (16,17) and the section (76) of the border edge (75) of the depressions, being located close to the axis A of the base (13).

* * * * *